US006615427B1

(12) United States Patent
Hailey

(10) Patent No.: US 6,615,427 B1
(45) Date of Patent: Sep. 9, 2003

(54) VENTED BED SHEET

(76) Inventor: Ellis R. Hailey, 3330 Allison Way, Louisville, KY (US) 40220

( * ) Notice: Subject to any disclaimer, the term of this patent is extended or adjusted under 35 U.S.C. 154(b) by 0 days.

(21) Appl. No.: 10/281,131

(22) Filed: Oct. 28, 2002

(51) Int. Cl.[7] ..... A47G 9/02
(52) U.S. Cl. ..... 5/495; 5/482; 5/486
(58) Field of Search ..... 5/482, 486, 652.1, 5/941, 495

(56) References Cited

U.S. PATENT DOCUMENTS 2,808,596 A * 10/1957 Schreiner ..... 5/486
3,325,832 A * 6/1967 Malacki ..... 5/487
3,696,450 A * 10/1972 Dupler ..... 5/486
5,181,287 A * 1/1993 Jun-Jie ..... 5/482
D379,893 S 6/1997 Dilbeck
5,675,848 A 10/1997 Kappel
5,749,109 A 5/1998 Kappel
6,112,348 A 9/2000 Dickerhoff

FOREIGN PATENT DOCUMENTS

GB 2198940 A * 6/1988

* cited by examiner

*Primary Examiner*—Michael F. Trettel
(74) *Attorney, Agent, or Firm*—Richard C. Litman

(57) ABSTRACT

A vented bed sheet used as an upper sheet of a sheeted bed has a plurality of evenly spaced apertures having a diameter of approximately ⅛ inch only arranged in rows in the upper-body half to dissipate the sleeper's body heat during sleep in a warm, humid and even an air-conditioned environment.

12 Claims, 2 Drawing Sheets

VENTED BED SHEET

BACKGROUND OF THE INVENTION

1. Field of the Invention

The present invention relates generally to bed sheets. More specifically, the invention is a bedsheet having a plurality of small apertures in the upper half of the sheet.

2. Description of the Related Art

The related art of interest describes various blankets and bed sheets, but none discloses the present invention. There is a need for an upper bed sheet with apertures in the upper body side for permitting body heat to dissipate via the apertures. It has been observed that perspiration occurs to become bothersome while asleep even in an air-conditioned bedroom and clearly in hot and/or humid climates. The related art will be discussed in the order of perceived relevance to the present invention.

U.S. Pat. No. 5,749,109 issued on May 12, 1998, to Thomas F. Kappel describes an inflatable blanket having selective air flow patterns in the lower sheet of the inflatable blanket. FIG. 2 shows the perforations are formed in an upper area in a rectangular pattern. The device is distinguishable for requiring an inflatable blanket and forced air ventilation.

U.S. Pat. No. 5,675,848 issued on Oct. 14, 1997, to Thomas F. Kappel describes an inflatable blanket having perforations of different sizes in the lower sheet for use in forced air convection systems to prevent hypothermia in patients. The perforations are arranged in different sizes so that a greater transfer of air may be provided in the areas directly over the patient. The device is distinguishable for requiring the apertures over an entire inflatable blanket and not a bed sheet.

U.S. Pat. No. 6,112,348 issued on Sep. 5, 2000, to Scott D. Dickerhoff describes an inflatable blanket having apertures overall and larger openings for a patient's toes or feet may protrude. The device is distinguishable for requiring an inflatable blanket with a plurality of small openings including larger openings at the feet end.

U.S. Design Pat. No. 379,893 issued on Jul. 17, 1997, to Hilda Dilbeck describes a unitary half sheet and half blanket device. The blanket portion has extended fibers on both the top and bottom sides. The device is distinguishable for requiring half portions of sheet and blanket without any apertures.

None of the above inventions and patents, taken either singularly or in combination, is seen to describe the instant invention as claimed. Thus, a vented bed sheet with the bottom portion unvented solving the aforementioned problems is desired.

SUMMARY OF THE INVENTION

A bed sheet used for the upper sheet of a sheeted bed has a plurality of evenly spaced apertures having a diameter of approximately ⅛ inch arranged in rows and columns in the upper body half and a border of 8–12 inches to dissipate the sleeper's body heat during sleep in any warm, humid and even air-conditioned environment for the person preferring to sleep only with a sheet covering his/her body.

Accordingly, it is a principal object of the invention to provide a vented bed sheet according to the present invention.

It is another object of the invention to provide a vented bed sheet having apertures only in the upper half according to the present invention.

It is a further object of the invention to provide a vented bed sheet with apertures spaced evenly in rows and columns according to the present invention.

Still another object of the invention is to provide a vented cotton bed sheet with embroidered apertures according to the present invention.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
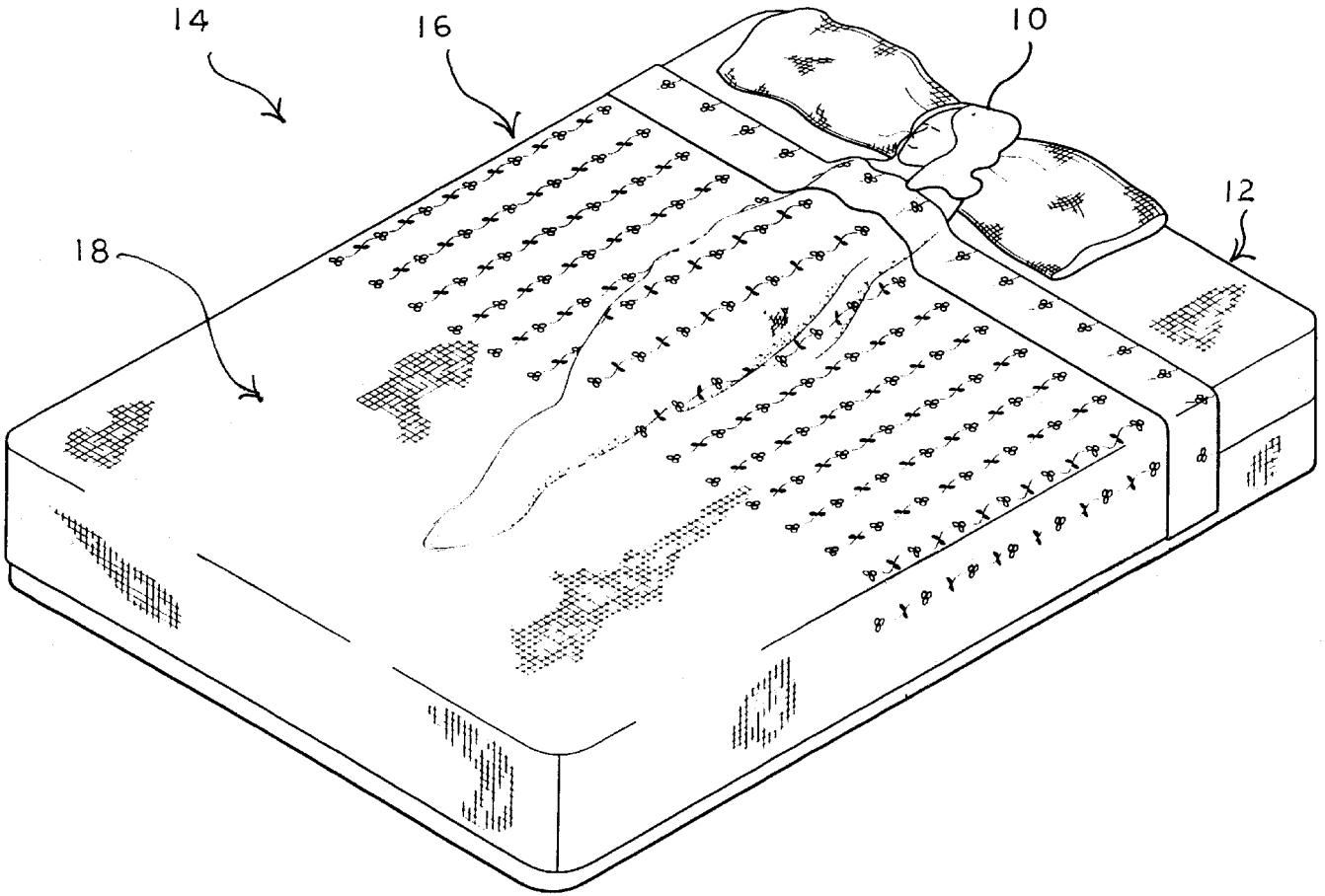
FIG. 1 is an environmental, perspective view of a woman sleeping under a vented bed sheet according to the present invention.
Figure 2:
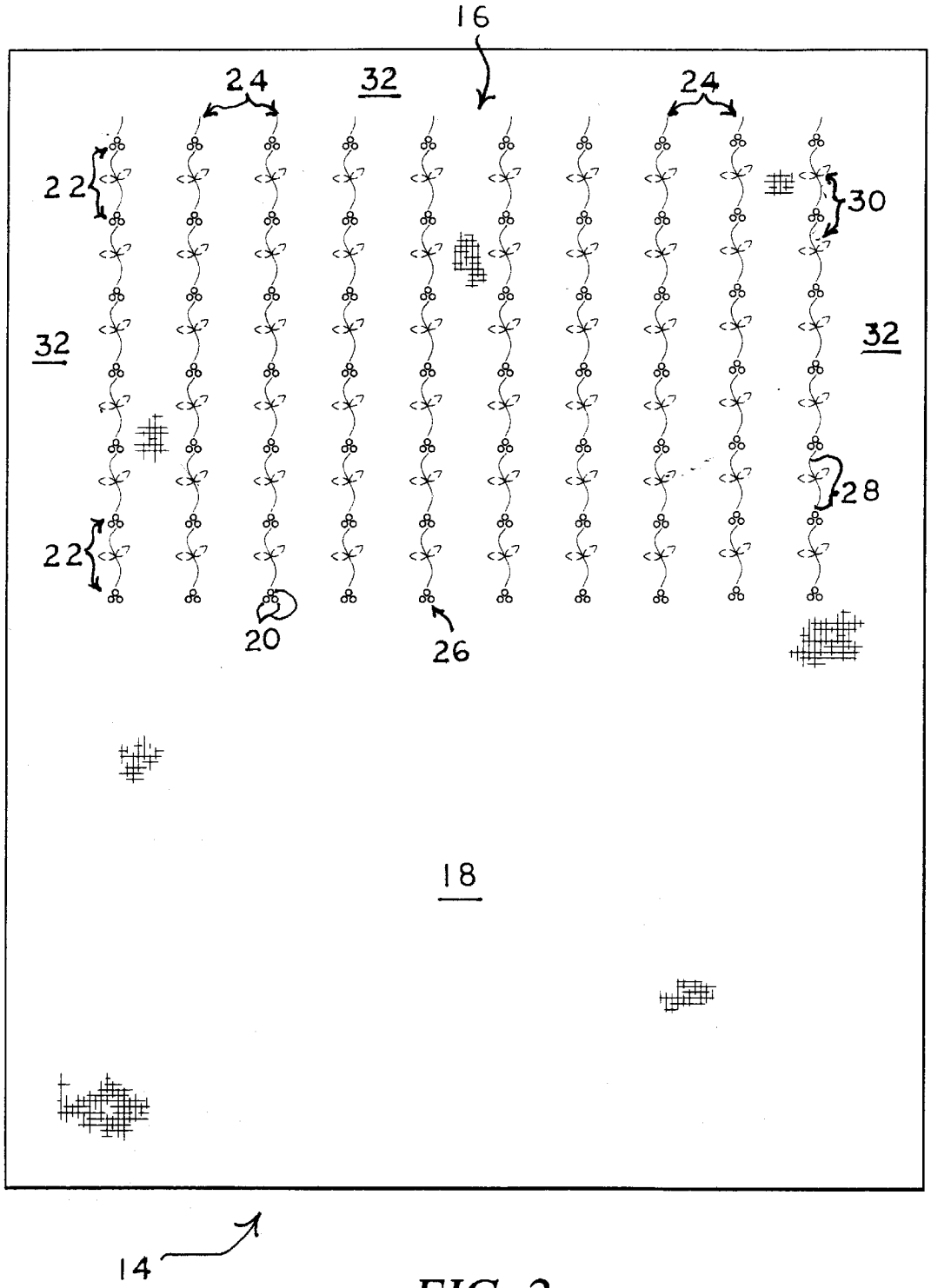
FIG. 2 is a top plan view of the vented bed sheet according to the present invention.

The present invention is directed in FIGS. 1 and 2 to a vented bed sheet useful for persons who sleep only with a bed sheet covering in warm and humid climates even with air, conditioning. In FIG. 1, a woman 10 is sleeping soundly in a bed 12 covered by the innovative vented bed sheet 14 with the knowledge that she can have a good night's rest without being awakened by the perspiration wet bed sheet.

As illustrated in FIG. 2, the rectangular bed sheet 14 has an upper perforated region 16 and a lower unperforated region 18. The uniform perforations 20 are spaced in evenly spaced rows 22 and columns 24. The circular perforations 20 are embroidered at their edges to prevent snagging and ripping. Three perforations 20 are decoratively formed in a triangular shape 26, and connected by a decorative embroidered stem 28 and leaf 30 pattern in a row 22 or column 24.

The perforations 20 all have the same diameter of one-eighth of an inch. A border 32 of 8–12 inches without any perforation is preferred for the perforated region 16. The bed sheet 14 can be cotton, polyester and mixtures thereof. The color of a bed sheet 14 can be white with white embroidery or even colored with matching or contrasting embroidery. The perforated region 16 can occupy approximately half the area of the bed sheet 14.

It is to be understood that the present invention is not limited to the embodiment described above, but encompasses any and all embodiments within the scope of the following claims.

I claim:

1. A vented bed sheet comprising:

a rectangular bed sheet having a top edge region devoid of perforations and extending eight to twelve inches from a top edge of said sheet, side edge regions, a bottom edge region, and an upper perforated region; and uniform perforations spaced in rows and columns in said perforated region;

whereby a restful sleep can be obtained under warm, humid and/or air-conditioned conditions.

2. The vented bed sheet according to claim 1, wherein the perforations are reinforced with embroidery.

3. The vented bed sheet according to claim 1, wherein the perforations are circular and one-eighth inch in diameter.

4. The vented bed sheet according to claim 1, wherein the perforations are formed in a triangle of three circular apertures.

5. The vented bed sheet according to claim 1, wherein the bottom region is approximately half the bed sheet area.

6. The vented bed sheet according to claim 1, wherein the rows or columns of perforations are connected by a sewn floral pattern with intermediate leaves.

7. A vented bed sheet comprising:

a rectangular bed sheet having a top edge region, side edge regions each of said side regions devoid of perforations and extending eight to twelve inches from a respective side edge of said sheet, a bottom edge region, and an upper perforated region; and uniform perforations spaced in rows and columns in said perforated region;

whereby a restful sleep can be obtained under warm, humid and/or air-conditioned conditions.

8. The vented bed sheet according to claims 7, wherein the perforations are reinforced with embroidery.

9. The vented bed sheet according to claim 7, wherein the perforations are circular and one-eighth inch in diameter.

10. The vented bed sheet according to claim 7, wherein the perforations are formed in a triangle of three circular apertures.

11. The vented bed sheet according to claim 7, wherein the bottom region is approximately half the bed sheet area.

12. The vented bed sheet according to claim 7, wherein the rows or columns of perforations are connected by a sewn floral pattern with intermediate leaves.

* * * * *